US005564201A

United States Patent [19]

O'Connell

[11] Patent Number: 5,564,201

[45] Date of Patent: Oct. 15, 1996

[54] NOVELTY FOOTWEAR PRODUCING SQUIRTING ACTION AND HAVING A TOE ACTIVATED PUMP

[76] Inventor: Gerard P. O'Connell, 35 Oakcrest Dr., Westfield, Mass. 01805

[21] Appl. No.: 530,487

[22] Filed: Sep. 19, 1995

Related U.S. Application Data

[63] Continuation of Ser. No. 2,389, Aug. 17, 1995, and a continuation-in-part of Ser. No. 328,882, Oct. 25, 1994, abandoned.

[51] Int. Cl.[6] ..... A43B 7/06; A43B 3/28/; A43B 3/30

[52] U.S. Cl. ..... 36/3 R; 36/112; 36/3 B

[58] Field of Search ..... 36/112, 132, 136, 36/1, 3 R, 3 B, 29, 116, 113, 139

[56] References Cited

U.S. PATENT DOCUMENTS

| | | | |
|---|---|---|---|
| 2,708,320 | 5/1955 | Hilton | 36/1 |
| 3,738,024 | 6/1973 | Matsuda | 36/2.5 R |
| 4,008,530 | 2/1977 | Gager | 36/28 |
| 4,009,528 | 3/1977 | Villari, Jr. et al. | 36/29 X |
| 4,106,222 | 8/1978 | Houck | 36/29 |
| 4,133,118 | 1/1979 | Khalsa et al. | 36/29 X |
| 4,674,200 | 6/1987 | Sing | 36/7.6 |
| 4,787,100 | 11/1988 | Jonat | 36/112 X |
| 5,179,792 | 1/1993 | Brantingham | 36/29 |
| 5,185,942 | 2/1993 | Decker | 36/29 X |

*Primary Examiner*—B. Dayoan
*Attorney, Agent, or Firm*—Charles B. Katz

[57] ABSTRACT

Novelty footwear has a reservoir for storing liquid within the footwear and selectively ejecting the liquid from footwear. The footwear includes a sole having the reservoir formed therein, the reservoir being further partitioned into a plurality of interconnected cells. The footwear is provided with a pumping actuatable by the toe of the wearer for forcing the liquid from the reservoir to the exterior of the footwear.

4 Claims, 3 Drawing Sheets

NOVELTY FOOTWEAR PRODUCING SQUIRTING ACTION AND HAVING A TOE ACTIVATED PUMP

CROSS-REFERENCES TO RELATED APPLICATIONS

This application is a continuation of a previous provisional application filed in the United States Patent and Trademark Office by Gerard P. O'Connell on Aug. 17, 1995 entitled NOVELTY FOOTWEAR PRODUCING SQUIRTING ACTION and assigned Ser. No. 60/002,389. This application is a continuation-in-part of a previous application filed in the United States Patent and Trademark Office by Gerard P. O'Connell on Oct. 25, 1994 entitled OVERSHOE OR WEATHER-PROTECTIVE SHOE INCORPORATING WATER-JET SQUIRTING DEVICE and assigned Ser. No. 08/328,882, now abandoned.

BACKGROUND OF THE INVENTION

The present invention relates to footwear, and more particularly to novelty footwear including a reservoir for holding liquid disposed within the sole of the footwear and means for selectively ejecting the liquid stored in said reservoir to the exterior of the footwear.

SUMMARY OF THE INVENTION

It is an object of the invention to provide a shoe, sneaker, boot, overshoe or other article of footwear which includes a mechanism permitting water or other liquids to be stored within the footwear and squirted to the exterior of the footwear when the wearer so desires. It is anticipated that such footwear will have a strong appeal to children.

The present invention comprises footwear having a hollow reservoir disposed within the sole of the footwear. The reservoir further includes filling means opening to the exterior of the footwear which allow the wearer to add water to the reservoir. The reservoir preferably comprises a plurality of interconnected cells, the cells bounded by a grid of sole support members, the sole's sidewalls and the solid floor and roof of the sole. The footwear additionally comprises at least one conduit, preferably comprising a flexible tube having a relatively narrow diameter, leading from the sole reservoir to a toe-actuated pump disposed within the sole proximal to the toe of the footwear. The pump is preferably of the piston type and includes a shaft extending upwardly through the roof of the sole and terminating at its upper end in a disk-shaped trigger located underneath and depressible by the wearer's big toe. The footwear is further provided With an outlet tube extending from the pump outlet through the toe portion of the sole to the exterior of the footwear. When the wearer desires to produce the squirting action, he depresses the pump trigger with his toe, causing liquid to be forced at elevated pressure through the outlet tube and ejected in a jet from the outlet tube exit.

As suggested above, the squirting mechanism may be incorporated into any type of footwear, including a conventional shoe, a sneaker or other type of athletic footwear, or an overshoe or weather-protective shoe.

DETAILED DESCRIPTION OF THE INVENTION

Figure 1:
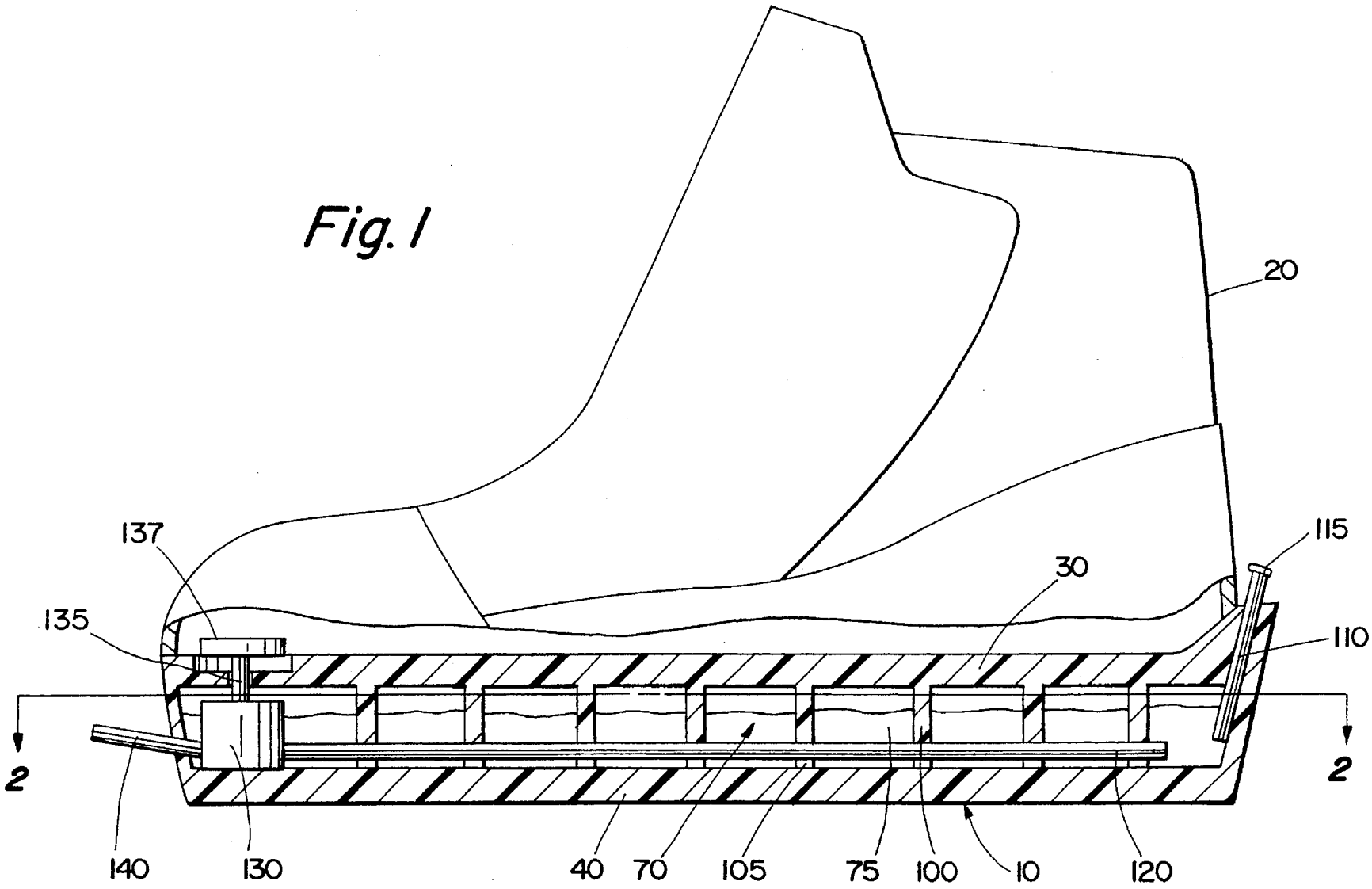
FIG. 1 is a partial sectional side view of the invention.

Making reference initially to FIG. 1, the present invention generally comprises sole 10 and upper 20. The upper is joined to the sole around the periphery thereof by any appropriate joining means, such as stitching or an adhesive. The upper includes means for securing the upper about the foot of the wearer. The securing means may comprise laces, complementary hook-and-loop ("Velcro®") fasteners, or any combination thereof or equivalent thereto.

It is noted that the essence of the invention lies in the arrangement of elements in the sole of the footwear. The sole comprises solid roof 30, floor 40, and first and second sidewalls 50 and 60 extending vertically from the sole floor to the sole roof around the periphery of the sole. The sidewalls converge at the front and rear of the footwear to form the toe and heel portions thereof. The solid surfaces of the sole roof, floor and sidewalls define reservoir 70, which is designed to hold a volume of liquid inside the sole.

Figure 2:
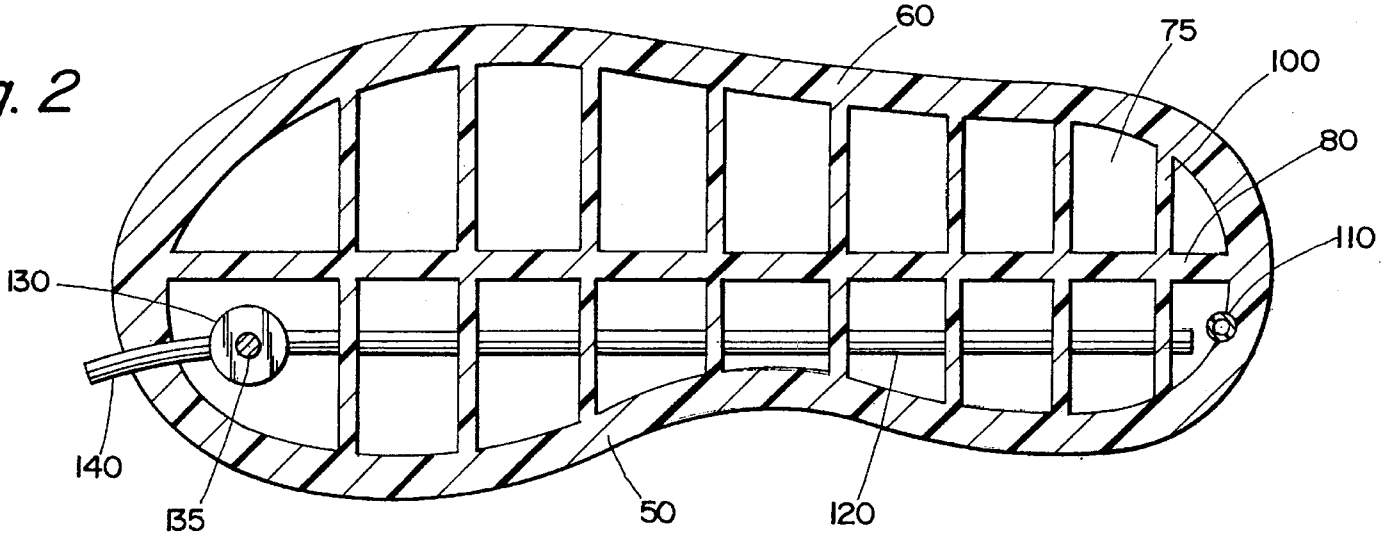
FIG. 2 is a cross-sectional view of the sole portion of the invention taken along line 2—2 of FIG. 1.
Figure 5:
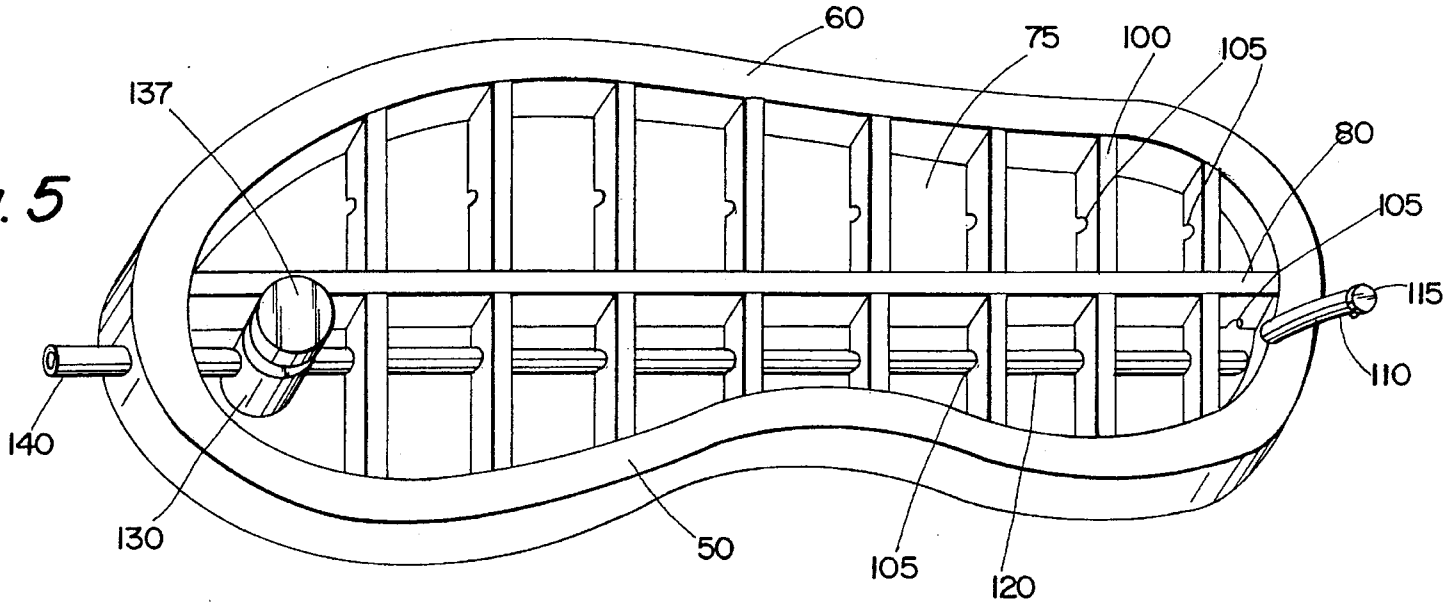
FIG. 5 is a perspective view of the sole portion of the invention.

Making reference now to. FIG. 2, the reservoir is divided into an array of interconnected cells 75 by longitudinal sole support member 80 and lateral sole support members (designated collectively as 100). As shown in FIG. 1, the sole support members extend vertically from the sole floor to the sole roof. The longitudinal sole support member extends horizontally along the length of the footwear between the heel and toe thereof. The lateral sole support members extend horizontally between the first and second sole sidewalls. Referring to FIG. 5, it is noted that the lateral sole support members are adapted with passageways 105 disposed in the lower margins thereof, the passageways permitting liquid to flow between adjacent cells. An additional passageway is located in the lower margin of the longitudinal sole support member between the rearmost cells, thereby permitting liquid to flow between the left and right rows of cells, which in turn ensures that the liquid level is equalized among all the cells.

The sole support members preserve the structural integrity of the sole and prevent the collapse of the sole roof due to the wearer's weight. It is noted that the number of longitudinal and lateral support members may be varied in order to optimize the construction of the footwear. It is additionally noted that the sole support members, along with the sole sidewalls and roof and floor, may be fabricated from any suitable resilient, flexible and impermeable material or combination of materials.

Filler tube 110 is disposed in the rear of the footwear and comprises a generally vertical tube having open upper and lower ends, the tube extending from one of the rearmost reservoir cells to the exterior of the footwear proximate to the heel. The filler tube allows water to be added to the reservoir by the wearer. The filler tube may include hinged cover 115 disposed at its upper end, the cover to be moved to its open position for filling the reservoir and closed thereafter for preventing the escape of water from the reservoir through the filler tube.

Referring to FIG. 5, conduit 120, comprising an elongated narrow tube allowing passage of water therethrough, extends from one of the rearmost reservoir cells to the inlet of pump 130. As is shown in FIG. 24, the conduit is threaded through the passageways disposed in the lower margins of the lateral sole support members. It is noted that the passageway area is substantially greater than the cross-sectional area of the conduit and that liquid may flow from cell to cell through the passageways around the outer diameter of the conduit.

Figure 3:
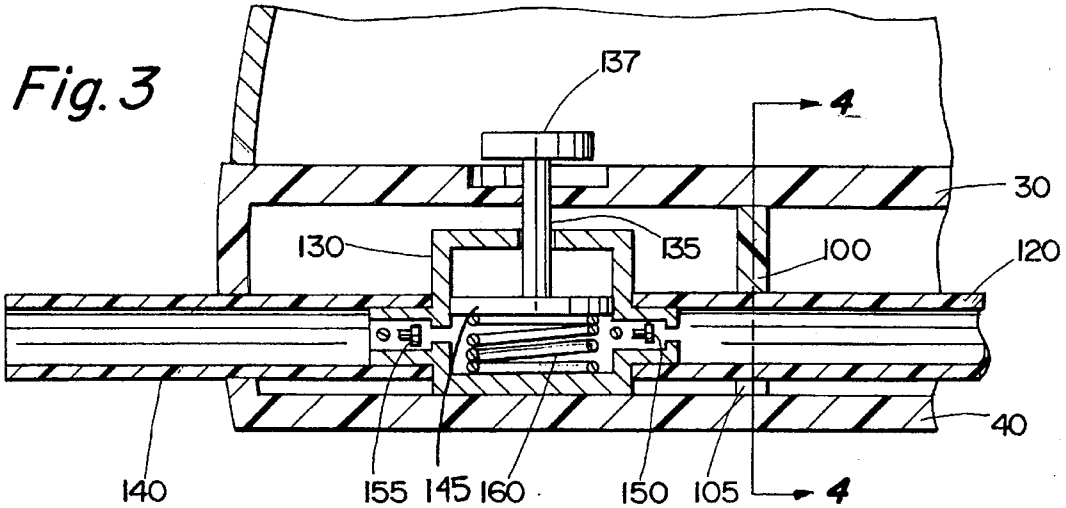
FIG. 3 is a fragmentary cross-sectional view of the invention, showing in particular the pumping means elements.
Figure 4:
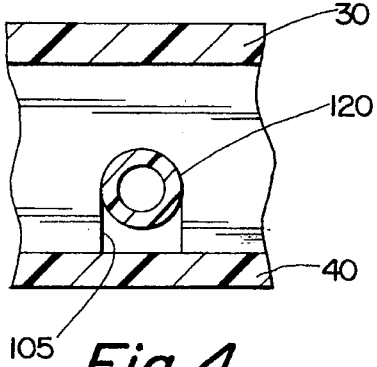
FIG. 4 is a fragmentary cross-sectional view of the invention taken along line 4—4 of FIG. 3 showing in particular an example of a passageway disposed in the sole support member.
Figure 6:
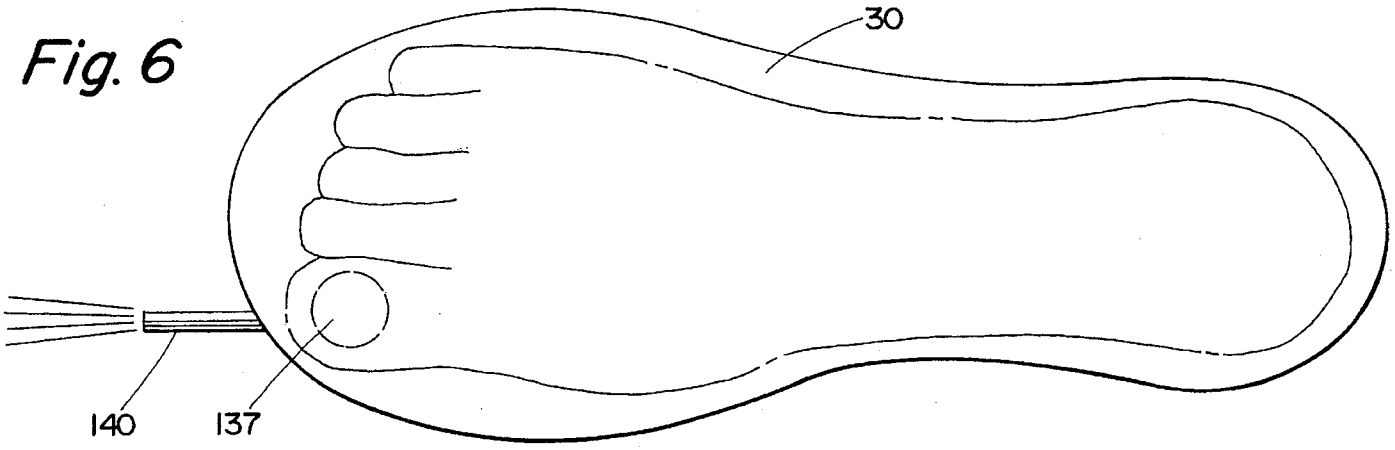
FIG. 6 is a top plan view of the sole portion of the invention, showing in particular the operation of the invention by the user.

Referring now to FIG. 3, the end of the conduit proximal to the toe of the wearer is connected to the pump inlet. The pump is a simple piston-type pump, similar to the pumps employed in squirt guns. The pump includes pump shaft 135 which extends upwardly through the sole roof and terminates at its distal end in disk-shaped trigger 137 disposed underneath the wearer's first ("big") toe, as shown in FIG. 6.

Referring again to FIG. 3, outlet tube 140 is connected to the outlet of the pump and extends through the sole sidewall to the exterior of the footwear near the toe thereof. When the wearer desires to effect the squirting action, he depresses the pump trigger with his toe, causing pump shaft 135 and piston 145 to move downwardly, thereby increasing the pressure of the liquid within the pump and closing inlet valve 150. The pressurized liquid is forced through pump outlet valve 155 and the outlet tube and is subsequently squirted in a jet from the exit of the outlet tube. When the wearer relaxes his toe, pump spring 160 urges the piston upward, thereby producing a partial vacuum within the pump. The partial vacuum thus produced causes liquid to flow from the reservoir through the conduit into the pump. The vacuum also causes the pump outlet valve to close preventing air from flowing from the exterior of the footwear through the outlet tube into the pump.

The footwear may include an ornament affixed to the front of the footwear, the ornament being adapted with a channel through which the external portion of the outlet may be threaded. For example, the ornament may be in the form of an animal head, with the water jet appearing to emanate from the "mouth" of the ornament.

It is noted that while a sneaker or athletic shoe embodiment of the invention is depicted in the figures, the invention is not to be construed as limited to this particular embodiment, and may instead be incorporated into a shoe, boot or overshoe construction.

While preferred embodiments of the invention have been shown and described, it will be apparent to those skilled in this art that various modifications may be made to these embodiments without departing from the essence of the present invention. For that reason, the scope of the invention is set forth in the following claims.

What is claimed is:

1. Footwear comprising:

a sole comprising a solid roof and floor and a first and second sidewall, said sidewalls extending vertically from said floor to said roof, said sidewalls being convergent at the front and rear of said footwear;

a hollow reservoir for holding a volume of liquid, said reservoir being defined by said sole roof and floor and said sole sidewalls;

means for adding liquid to said reservoir from the exterior of the footwear;

a conduit having a first end and a second end, said first end being open to said reservoir, said conduit permitting the passage of liquid therethrough;

pumping means connected to the second end of said conduit, said pumping means being responsive to the motion of the toe of the wearer;

an outlet tube connected to the outlet of said pump, said outlet tube extending to the exterior of said footwear, and;

means for securing said sole proximate to the wearer's foot.

2. Footwear according to claim 1 wherein said pumping means comprises a piston pump, said piston pump having a shaft extending upwardly through said sole roof and terminating at its distal end in a disk-shaped trigger disposed underneath and depressible by the toe of the wearer, whereby depressing the trigger causes said piston pump to expel water from said reservoir to the exterior of said footwear through said outlet tube.

3. Footwear according to claim 1 wherein said reservoir comprises a plurality of interconnected cells, said plurality of cells being defined by a grid of longitudinal and lateral sole support members, each of said sole support members extending vertically from the sole floor to the sole roof, the sole support members having a series of passageways formed therethrough allowing each cell to be in liquid communication with the cells located adjacent thereto.

4. Footwear according to claim 1 wherein the means for adding liquid to said reservoir comprises a substantially vertical filler tube having a lower end open to said reservoir and an upper end normally open to the exterior of the footwear, said filler tube being disposed proximate to the heel of said footwear, said filler tube including means for releasably closing said upper end.

* * * * *